US007483835B2

(12) United States Patent
Neuhauser et al.

(10) Patent No.: US 7,483,835 B2
(45) Date of Patent: Jan. 27, 2009

(54) AD DETECTION USING ID CODE AND EXTRACTED SIGNATURE

(75) Inventors: Alan R. Neuhauser, Silver Spring, MD (US); Thomas W. White, Annapolis, MD (US)

(73) Assignee: Arbitron, Inc.

( * ) Notice: Subject to any disclaimer, the term of this patent is extended or adjusted under 35 U.S.C. 154(b) by 693 days.

(21) Appl. No.: 10/328,201

(22) Filed: Dec. 23, 2002

(65) Prior Publication Data

US 2004/0122679 A1 Jun. 24, 2004

(51) Int. Cl.
*G10L 21/00* (2006.01)

(52) U.S. Cl. ..... 704/273; 704/270; 725/19; 713/176

(58) Field of Classification Search ..... 704/270–275; 382/100; 380/54; 725/22; 713/176
See application file for complete search history.

(56) References Cited

U.S. PATENT DOCUMENTS

| | | | | |
|---|---|---|---|---|
| 2,662,168 | A | 12/1953 | Scherbatsoy | 250/2 |
| 3,919,479 | A | 11/1975 | Moon et al. | 179/1 SB |
| 4,230,990 | A | 10/1980 | Lert et al. | 455/67 |
| 4,450,604 | A | 5/1984 | Oowada | 364/604 |
| 4,677,466 | A | 6/1987 | Lert et al. | 358/84 |
| 4,697,209 | A | 9/1987 | Kiewit et al. | 358/84 |
| 4,739,398 | A | 4/1988 | Thomas et al. | 358/84 |
| 4,843,562 | A | 6/1989 | Kenyon et al. | 364/487 |
| 4,918,730 | A | 4/1990 | Schulze | 381/43 |
| 4,955,070 | A | 9/1990 | Welsh et al. | 455/2 |
| 4,972,471 | A | 11/1990 | Gross et al. | 380/3 |
| 5,319,735 | A | 6/1994 | Preuss et al. | 395/2.14 |
| 5,425,100 | A | 6/1995 | Thomas et al. | 380/20 |
| 5,450,490 | A | 9/1995 | Jensen et al. | 380/6 |
| 5,481,294 | A | 1/1996 | Thomas et al. | 348/1 |
| 5,512,933 | A | 4/1996 | Wheatley et al. | 348/5 |
| 5,574,962 | A | 11/1996 | Fardeau et al. | 455/2 |
| 5,579,124 | A | 11/1996 | Aijala et al. | 386/96 |
| 5,581,800 | A | 12/1996 | Fardeau et al. | 455/2 |
| 5,594,934 | A | 1/1997 | Lu et al. | 455/2 |
| 5,612,729 | A | 3/1997 | Ellis et al. | 348/2 |
| 5,764,763 | A | 6/1998 | Jensen et al. | 380/6 |
| 5,787,334 | A | 7/1998 | Fardeau et al. | 455/2 |
| 5,828,325 | A | 10/1998 | Wolosewicz et al. | 341/52 |
| 5,945,932 | A | 8/1999 | Smith et al. | 341/51 |
| 6,035,177 | A * | 3/2000 | Moses et al. | 725/22 |
| 6,061,793 | A * | 5/2000 | Tewfik et al. | 713/176 |
| 6,154,484 | A | 11/2000 | Lee et al. | 375/130 |
| 6,175,627 | B1 | 1/2001 | Petrovic et al. | 380/42 |
| 6,208,735 | B1 * | 3/2001 | Cox et al. | 380/54 |
| 6,647,128 | B1 * | 11/2003 | Rhoads | 382/100 |
| 6,700,990 | B1 * | 3/2004 | Rhoads | 382/100 |
| 6,738,744 | B2 * | 5/2004 | Kirovski et al. | 704/273 |
| 2004/0022322 | A1 * | 2/2004 | Dye | 375/240.26 |

FOREIGN PATENT DOCUMENTS

| | | |
|---|---|---|
| WO | WO 91/11062 | 7/1991 |

(Continued)

*Primary Examiner*—Vijay B Chawan
(74) *Attorney, Agent, or Firm*—Katten Muchin Rosenman

(57) ABSTRACT

Systems and methods are provided for gathering audience measurement data relating to receipt of and/or exposure to audio data by an audience member. A signature characterizing the audio data and additional data are obtained, and the audio data is identified based on both.

104 Claims, 14 Drawing Sheets

FOREIGN PATENT DOCUMENTS

| | | |
|---|---|---|
| WO | WO 95/12278 | 5/1995 |
| WO | WO 96/27264 | 9/1996 |
| WO | WO 98/10539 | 3/1998 |
| WO | WO 98/26529 | 6/1998 |
| WO | WO 98/32251 | 7/1998 |
| WO | WO 99/59275 | 11/1999 |
| WO | WO 00/04662 | 1/2000 |
| WO | WO 00/72309 | 11/2000 |

* cited by examiner

AD DETECTION USING ID CODE AND EXTRACTED SIGNATURE

FIELD OF THE INVENTION

The invention relates to systems and methods for gathering data reflecting receipt of, and/or exposure to, audio data by encoding and obtaining both signature data and additional data and identifying the audio data based on both.

BACKGROUND OF THE INVENTION

There is considerable interest in identifying and/or measuring the receipt of, and or exposure to, audio data by an audience in order to provide market information to advertisers, media distributors, and the like, to verify airing, to calculate royalties, to detect piracy, and for any other purposes for which an estimation of audience receipt or exposure is desired.

The emergence of multiple, overlapping media distribution pathways, as well as the wide variety of available user systems (e.g. PC's, PDA's, portable CD players, Internet, appliances, TV, radio, etc.) for receiving audio data, has greatly complicated the task of measuring audience receipt of, and exposure to, individual program segments. The development of commercially viable techniques for encoding audio data with program identification data provides a crucial tool for measuring audio data receipt and exposure across multiple media distribution pathways and user systems.

One such technique involves adding an ancillary code to the audio data that uniquely identifies the program signal. Most notable among these techniques is the methodology developed by Arbitron Inc., which is already providing useful audience estimates to numerous media distributors and advertisers.

An alternative technique for identifying program signals is extraction and subsequent pattern matching of "signatures" of the program signals. Such techniques typically involve the use of a reference signature database, which contains a reference signature for each program signal the receipt of which, and exposure to which, is to be measured. Before the program signal is broadcast, these reference signatures are created by measuring the values of certain features of the program signal and forming a feature set or "signature" from these values, commonly termed "signature extraction", which is then stored in the database. Later, when the program signal is broadcast, signature extraction is again performed, and the signature obtained is compared to the reference signatures in the database until a match is found and the program signal is thereby identified.

However, one disadvantage of using such pattern matching techniques is that, after a signature is extracted from a program signal, the signature must be compared to numerous reference signatures in the database until a match is found. This problem is further exacerbated in systems that do not use a "cue" or "start" code to trigger the extraction of the signature at a particular predetermined point in the program signal, as such systems require the program signal to continually undergo signature extraction, and each of these many successive signatures extracted from a single program signal must be compared to each and every reference signature in the database until a match is found. This, of course, requires a tremendous amount of data processing, which, due to the ever increasing methods and amounts of audio data transmission, is becoming more and more economically impractical.

Accordingly, it is desired to provide techniques for gathering data reflecting receipt of and/or exposure to audio data that require minimal processing and storage resources.

It is also desired to provide such data gathering techniques which are likely to be adaptable to future media distribution paths and user systems.

SUMMARY OF THE INVENTION

For this application, the following terms and definitions shall apply, both for the singular and plural forms of nouns and for all verb tenses:

The term "data" as used herein means any indicia, signals, marks, domains, symbols, symbol sets, representations, and any other physical form or forms representing information, whether permanent or temporary, whether visible, audible, acoustic, electric, magnetic, electromagnetic, or otherwise manifested.

The term "audio data" as used herein means any data representing acoustic energy, including, but not limited to, audible sounds, regardless of the presence of any other data, or lack thereof, which accompanies, is appended to, is superimposed on, or is otherwise transmitted or able to be transmitted with the audio data.

The term "network" as used herein means networks of all kinds, including both intra-networks, such as a single-office network of computers, and inter-networks, such as the Internet, and is not limited to any particular such network.

The term "source identification code" as used herein means any data that is indicative of a source of audio data, including, but not limited to, (a) persons or entities that create, produce, distribute, reproduce, communicate, have a possessory interest in, or are otherwise associated with the audio data, or (b) locations, whether physical or virtual, from which data is communicated, either originally or as an intermediary, and whether the audio data is created therein or prior thereto.

The terms "audience" and "audience member" as used herein mean a person or persons, as the case may be, who access media data in any manner, whether alone or in one or more groups, whether in the same or various places, and whether at the same time or at various different times.

The term "processor" as used herein means data processing devices, apparatus, programs, circuits, systems, and subsystems, whether implemented in hardware, software, or both and whether operative to process analog or digital data, or both.

The terms "communicate" and "communicating" as used herein include both conveying data from a source to a destination, as well as delivering data to a communications medium, system or link to be conveyed to a destination. The term "communication" as used herein means the act of communicating or the data communicated, as appropriate.

The terms "coupled", "coupled to", and "coupled with" shall each mean a relationship between or among two or more devices, apparatus, files, programs, media, components, networks, systems, subsystems, and/or means, constituting any one or more of (a) a connection, whether direct or through one or more other devices, apparatus, files, programs, media, components, networks, systems, subsystems, or means, (b) a communications relationship, whether direct or through one or more other devices, apparatus, files, programs, media, components, networks, systems, subsystems, or means, or (c) a functional relationship in which the operation of any one or more of the relevant devices, apparatus, files, programs, media, components, networks, systems, subsystems, or means depends, in whole or in part, on the operation of any one or more others thereof.

In accordance with one aspect of the present invention, a method is provided for identifying audio data received at an audience member's location. The method comprises obtaining signature data from the received audio data characterizing the received audio data; obtaining additional data from the received audio data; and producing an identification of the received audio data based both on the signature data and the additional data.

In accordance with another aspect of the present invention, a system is provided for identifying audio data received at an audience member's location. The system comprises a first means to obtain signature data from the received audio data characterizing the received audio data; a second means to obtain additional data from the received audio data; and a third means to produce an identification of the received audio data based both on the signature data and the additional data.

In accordance with a further aspect of the present invention, a method is provided for encoding audio data for gathering data reflecting receipt of and/or exposure to the audio data. The method comprises forming a database having a plurality of reference signature data sets, each of which signature data sets characterizes identified audio data; grouping the reference signatures into a plurality of signature data groups; and encoding audio data to be monitored with data denoting one of the signature data groups.

In accordance with still another aspect of the present invention, a system is provided for encoding audio data for gathering data reflecting receipt of and/or exposure to the audio data. The system comprises a database having a plurality of signature groups, each of which groups has at least one reference signature data set, each of which signature data sets characterizes identified audio data; and an encoder to encode audio data to be monitored with data denoting one of the signature data groups.

DETAILED DESCRIPTION OF CERTAIN ADVANTAGEOUS EMBODIMENTS

Figure 1:
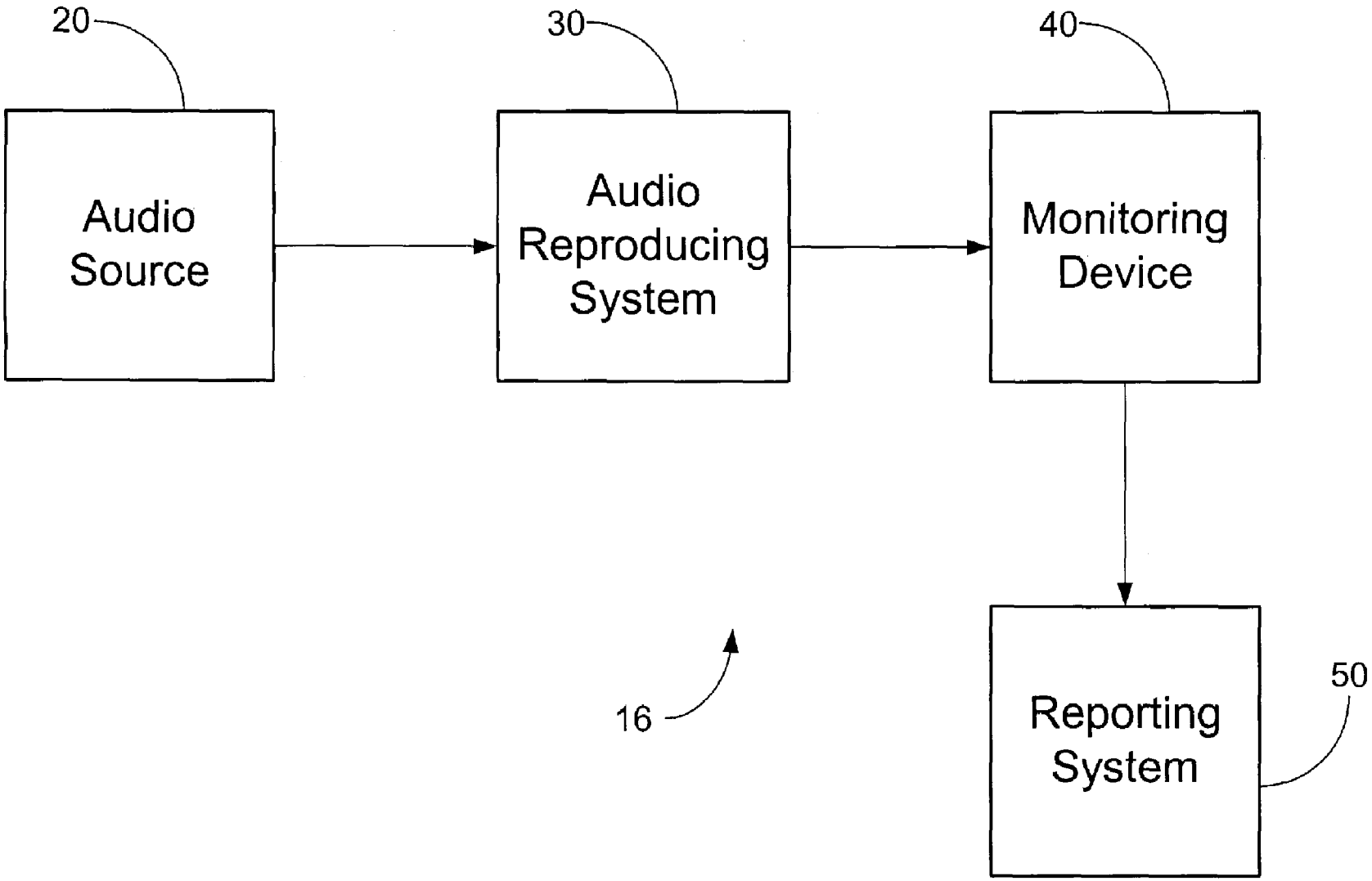
FIG. 1 is a functional block diagram for use in illustrating systems and methods for gathering data reflecting receipt and/or exposure to audio data in accordance with various embodiments of the present invention.

FIG. 1 illustrates various embodiments of a system 16 including an implementation of the present invention for gathering data reflecting receipt of and/or exposure to audio data. The system 16 includes an audio source 20 that communicates audio data to an audio reproducing system 30 at an audience member's location. While source 20 and system 30 are shown as separate boxes in FIG. 1, this illustration serves only to represent the path of the audio data, and not necessarily the physical arrangement of the devices. For example, the source 20 and the system 30 may be located either at a single location or at separate locations remote from each other. Further, the source 20 and the system 30 may be, or be located within, separate devices coupled to each other, either permanently or temporarily/intermittently, or one may be a peripheral of the other or of a device of which the other is a part, or both may be located within a single device, as will be further explained below.

The particular audio data to be monitored varies between particular embodiments and can include any audio data which may be reproduced as acoustic energy, the measurement of the receipt of which, or exposure to which, may be desired. In certain advantageous embodiments, the audio data represents commercials having an audio component, monitored, for example, in order to estimate audience exposure to commercials or to verify airing. In other embodiments, the audio data represents other types of programs having an audio component, including, but not limited to, television programs or movies, monitored, for example, in order to estimate audience exposure or verify their broadcast. In yet other embodiments, the audio data represents songs, monitored, for example, in order to calculate royalties or detect piracy. In still other embodiments, the audio data represents streaming media having an audio component, monitored, for example, in order to estimate audience exposure. In yet other embodiments, the audio data represents other types of audio files or audio/video files, monitored, for example, for any of the reasons discussed above.

After the system 30 receives the audio data, in certain embodiments, the system 30 reproduces the audio data as acoustic audio data, and the system 16 further includes a monitoring device 40 that detects this acoustic audio data. In other embodiments, the system 30 communicates the audio data via a connection to monitoring device 40, or through other wireless means, such as RF, optical, magnetic and/or electrical means. While system 30 and monitoring device 40 are shown as separate boxes in FIG. 1, this illustration serves only to represent the path of the audio data, and not necessarily the physical arrangement of the devices. For example, the monitoring device 40 may be a peripheral of, or be located within, either as hardware or as software, the system 30, as will be further explained below.

After the audio data is received by the monitoring device 40, which in certain embodiments comprises one or more processors, the monitoring device 40 forms signature data characterizing the audio data. Suitable techniques for extracting signatures from audio data are disclosed in U.S. Pat. No. 5,612,729 to Ellis, et al. and in U.S. Pat. No. 4,739,398 to Thomas, et al., each of which is assigned to the assignee of the present invention and both of which are incorporated herein by reference.

Still other suitable techniques are the subject of U.S. Pat. No. 2,662,168 to Scherbatskoy, U.S. Pat. No. 3,919,479 to Moon, et al., U.S. Pat. No. 4,697,209 to Kiewit, et al., U.S. Pat. No. 4,677,466 to Lert, et al., U.S. Pat. No. 5,512,933 to Wheatley, et al, U.S. Pat. No. 4,955,070 to Welsh, et al., U.S. Pat. No. 4,918,730 to Schulze, U.S. Pat. No. 4,843,562 to Kenyon, et al., U.S. Pat. No. 4,450,531 to Kenyon, et al., U.S. Pat. No. 4,230,990 to Lert, et al., U.S. Pat. No. 5,594,934 to Lu, et al., and PCT publication WO91/11062 to Young, et al., all of which are incorporated herein by reference.

Specific methods for forming signature data include the techniques described below. It is appreciated that this is not an exhaustive list of the techniques that can be used to form signature data characterizing the audio data.

In certain embodiments, the audio signature data is formed by using variations in the received audio data. For example, in some of these embodiments, the signature is formed by forming a signature data set reflecting time-domain variations of the received audio data, which set, in some embodiments, reflects such variations of the received audio data in a plurality of frequency sub-bands of the received audio data. In others of these embodiments, the signature is formed by forming a signature data set reflecting frequency-domain variations of the received audio data.

In certain other embodiments, the audio signature data is formed by using signal-to-noise ratios that are processed for a plurality of predetermined frequency components of the audio data and/or data representing characteristics of the audio data. For example, in some of these embodiments, the signature is formed by forming a signature data set comprising at least some of the signal-to-noise ratios. In others of these embodiments, the signature is formed by combining selected ones of the signal-to-noise ratios. In still others of these embodiments, the signature is formed by forming a signature data set reflecting time-domain variations of the signal-to-noise ratios, which set, in some embodiments, reflects such variations of the signal-to-noise ratios in a plurality of frequency sub-bands of the received audio data, which, in some such embodiments, are substantially single frequency sub-bands. In still others of these embodiments, the signature is formed by forming a signature data set reflecting frequency-domain variations of the signal-to-noise ratios.

In certain other embodiments, the signature data is obtained at least in part from the additional data and/or from an identification code in the audio data, such as a source identification code. In certain of such embodiments, the code comprises a plurality of code components reflecting characteristics of the audio data and the audio data is processed to recover the plurality of code components. Such embodiments are particularly useful where the magnitudes of the code components are selected to achieve masking by predetermined portions of the audio data. Such component magnitudes, therefore, reflect predetermined characteristics of the audio data, so that the component magnitudes may be used to form a signature identifying the audio data.

In some of these embodiments, the signature is formed as a signature data set comprising at least some of the recovered plurality of code components. In others of these embodiments, the signature is formed by combining selected ones of the recovered plurality of code components. In yet other embodiments, the signature can be formed using signal-to-noise ratios processed for the plurality of code components in any of the ways described above. In still further embodiments, the code is used to identify predetermined portions of the audio data, which are then used to produce the signature using any of the techniques described above. It will be appreciated that other methods of forming signatures may be employed.

After the signature data is formed in the monitoring device 40, it is communicated to a reporting system 50, which processes the signature data to produce data representing the identity of the program segment. While monitoring device 40 and reporting system 50 are shown as separate boxes in FIG. 1, this illustration serves only to represent the path of the audio data and derived values, and not necessarily the physical arrangement of the devices. For example, the reporting system 50 may be located at the same location as, either permanently or temporarily/intermittently, or at a location remote from, the monitoring device 40. Further, the monitoring device 40 and the reporting system 50 may be, or be located within, separate devices coupled to each other, either permanently or temporarily/intermittently, or one may be a peripheral of the other or of a device of which the other is a part, or both may be located within, or implemented by, a single device.

In addition to the signature data, additional data is also communicated to the reporting system 50, which uses the additional data, in conjunction with the signature data, to identify the program segment.

Figure 2:
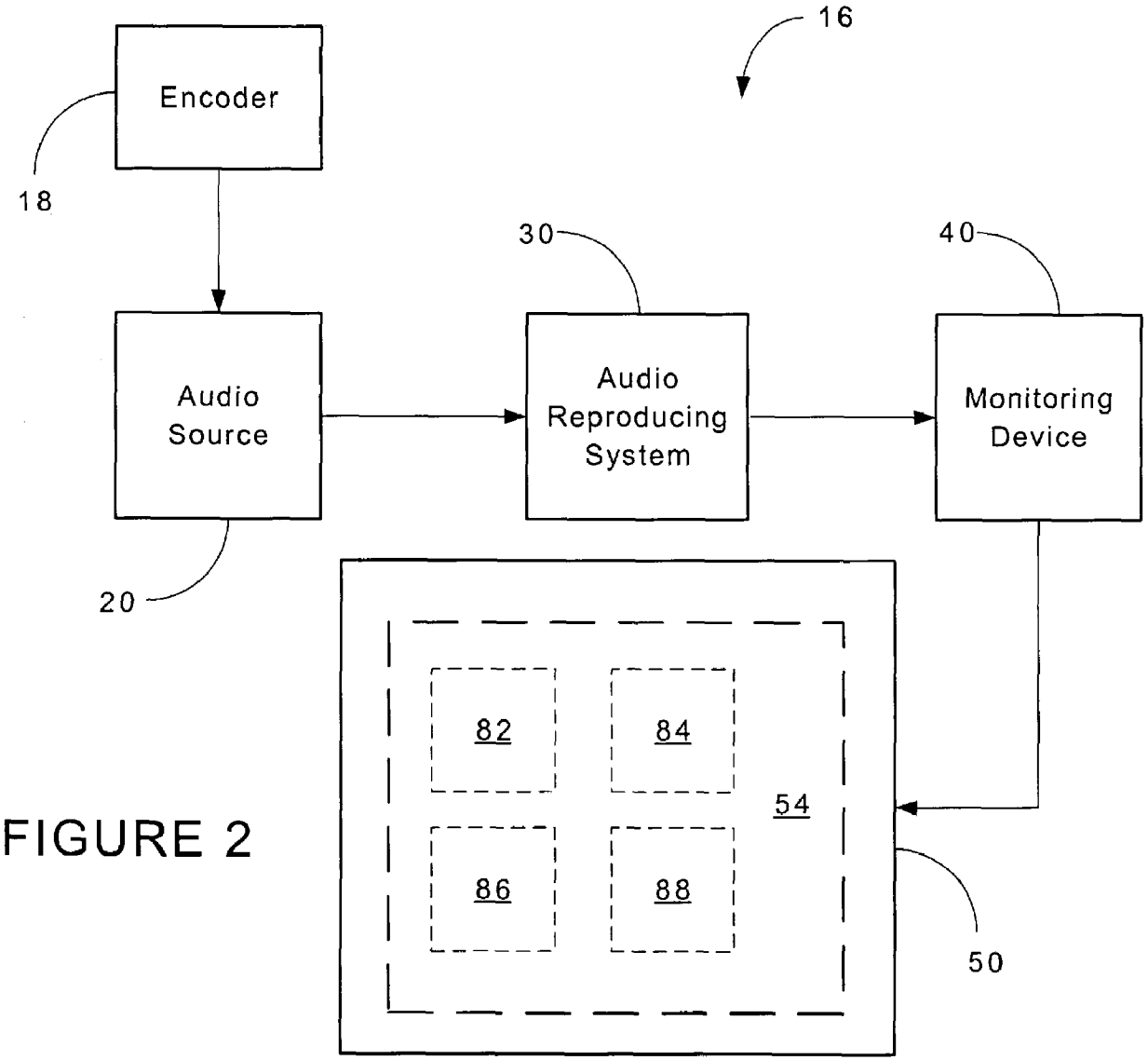
FIG. 2 is a functional block diagram for use in illustrating certain embodiments of the present invention.

As shown in FIG. 2, which illustrates certain advantageous embodiments of the system 16, an encoder 18 encodes the audio data with the additional data. The encoder 18 encodes the audio data with the additional data at the audio source 20 or prior thereto, such as, for example, in the recording studio or at any other time the audio is recorded or re-recorded (i.e. copied) prior to its communication from the encoder 18 to the audio source 20. While encoder 18 and source 20 are shown as separate boxes in FIG. 2, this illustration serves only to represent the path of the audio data, and not necessarily the physical arrangement of the devices. For example, the encoder 18 and source 20 may be located either at a single location or at separate locations remote from each other. Further, the encoder 18 and the source 20 may be, or be located within, separate devices coupled to each other, either permanently or temporarily/intermittently, or one may be a peripheral of the other or of a device of which the other is a part, or both may be located within a single device.

In certain embodiments, the reporting system 50 has a database 54 containing reference audio signature data of identified audio data, with which the audio signature data formed in the monitoring device 40 is compared in order to identify the received audio data, as will be further explained below. In certain advantageous embodiments, prior to encoding the audio data with the additional data, the reference signatures forming the database 54 are grouped into a plurality of signature groups 82, 84, 86, 88. Accordingly, when the audio data to be monitored is encoded with the additional data, this additional data denotes the signature group in which the reference signature corresponding to the signature that is extracted from the monitored audio data is located. This type of encoded data has certain advantages that may be desired, such as, for example, drastically reducing the maximum number of reference signatures against which signature data extracted from the monitored audio data must be compared in order to ensure that a match occurs.

In some embodiments, the reference signatures may be grouped arbitrarily. In other embodiments, the reference signatures may be grouped according to some attribute of the audio data, such as a characteristic of the audio data itself, such as, for example, its duration, or a characteristic of the content of the program segment, such as, for example the program type (e.g. "commercial"). Similarly, in other embodiments, the reference signatures may be grouped according to the expected uses of the audio data, such as, for example, the ranges of time during which the audio data will be broadcast, such that particular reference signature groups may be compressed during periods when reference to the signatures in those groups is not required, which reduces the amount of storage space needed, or such that this data may be archived and stored at a location remote from the location where signature comparisons are performed, and particular reference signature groups may be retrieved therefrom only when needed, deleted when not needed, and then retrieved again when needed again.

Figure 3:
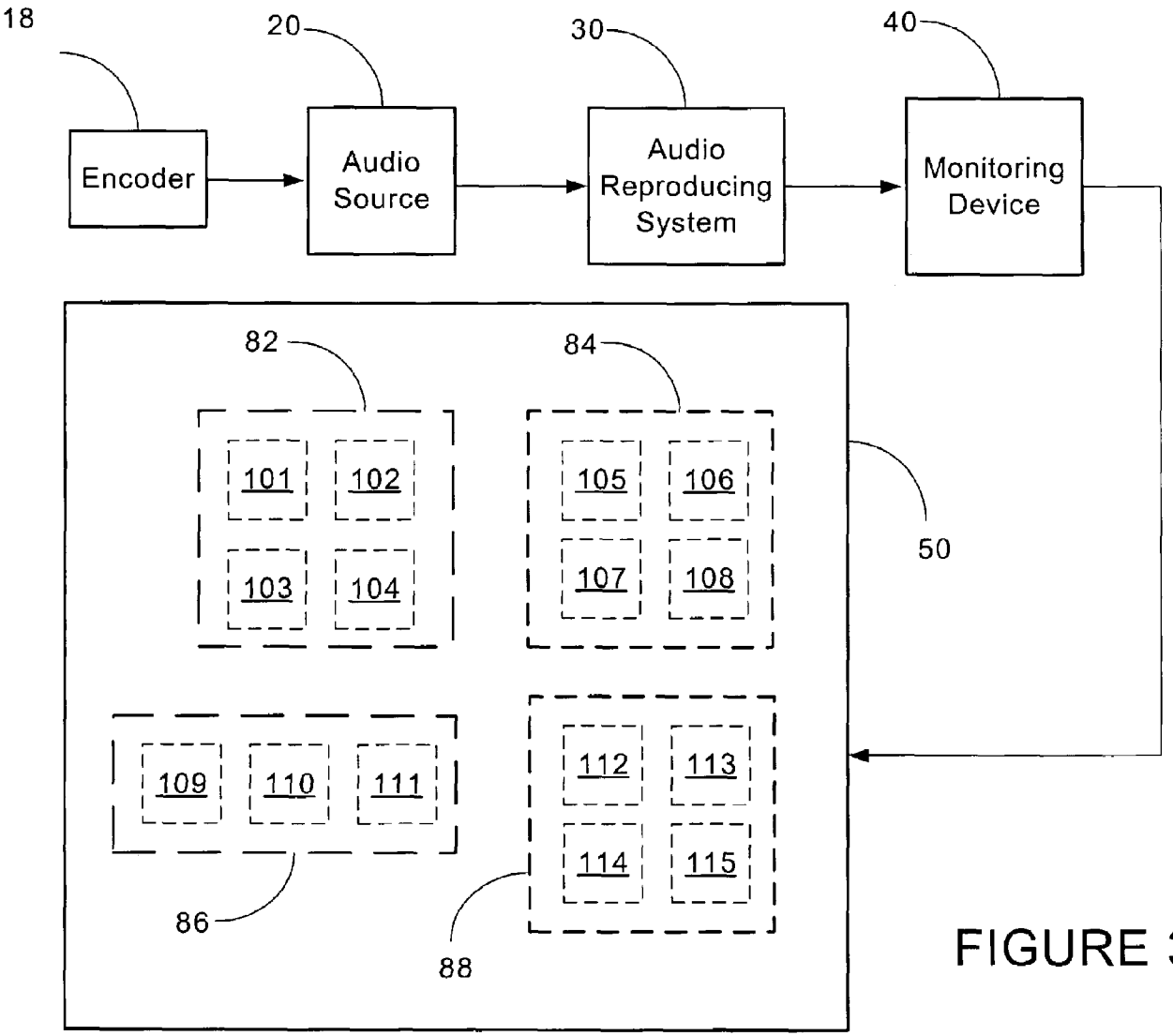
FIG. 3 is a functional block diagram for use in illustrating further embodiments of the present invention.

As shown in FIG. 3, which illustrates certain advantageous embodiments of the system 16, the reference signature groups 82, 84, 86, 88 are further divided into reference signature subgroups 101-115. Accordingly, the audio data to be monitored is encoded with further additional data to denote the particular subgroup in which the reference signature for audio data to be monitored is located. By using this sort of signature group tree, the maximum number of reference signatures against which signatures extracted from the audio data to be monitored must be compared can be exponentially decreased, ad infinitum, until the desired balance between signature comparison and code detection (i.e. the detection of codes denoting particular signature groups and subgroups) is achieved.

In some embodiments, the encoder 18 will encode the audio data with the additional data prior to its communication from the encoder 18 to the source 20. However, as noted above, the audio data may be encoded with the additional data at the source 20, such as, for example, when the reference signatures are not grouped arbitrarily, but instead, are grouped in accordance with a particular attribute of the program segment, such as, for example, by program type (e.g. "commercial").

The additional data may be added to the audio data using any encoding technique suitable for encoding audio signals that are reproduced as acoustic energy, such as, for example, the techniques disclosed in U.S. Pat. No. 5,764,763 to Jensen, et al., and modifications thereto, which is assigned to the assignee of the present invention and which is incorporated herein by reference. Other appropriate encoding techniques are disclosed in U.S. Pat. No. 5,579,124 to Aijala, et al., U.S. Pat. Nos. 5,574,962, 5,581,800 and 5,787,334 to Fardeau, et al., U.S. Pat. No. 5,450,490 to Jensen, et al., and U.S. patent application Ser. No. 09/318,045, in the names of Neuhauser, et al., each of which is assigned to the assignee of the present application and all of which are incorporated herein by reference.

Still other suitable encoding techniques are the subject of PCT Publication WO 00/04662 to Srinivasan, U.S. Pat. No. 5,319,735 to Preuss, et al., U.S. Pat. No. 6,175,627 to Petrovich, et al., U.S. Pat. No. 5,828,325 to Wolosewicz, et al., U.S. Pat. No. 6,154,484 to Lee, et al., U.S. Pat. No. 5,945,932 to Smith, et al., PCT Publication WO 99/59275 to Lu, et al., PCT Publication WO 98/26529 to Lu, et al., and PCT Publication WO 96/27264 to Lu, et al, all of which are incorporated herein by reference.

In certain advantageous embodiments, the audio signature data is formed from at least a portion of the program segment containing the additional data. This type of signature formation has certain advantages that may be desired, such as, for example, the ability to use the additional data as part of, or as part of the process for forming, the audio signature data, as well as the availability of other information contained in the encoded portion of the program segment for use in creating the signature data.

In another advantageous embodiment, the audio data communicated from the audio source 20 to the system 30 also includes a source identification code. The source identification code may include data identifying any individual source or group of sources of the audio data, which sources may include an original source or any subsequent source in a series of sources, whether the source is located at a remote location, is a storage medium, or is a source that is internal to, or a peripheral of, the system 30. In certain embodiments, the source identification code and the additional data are present simultaneously in the audio data, while in other embodiments they are present in different time segments of the audio data.

Figure 4:
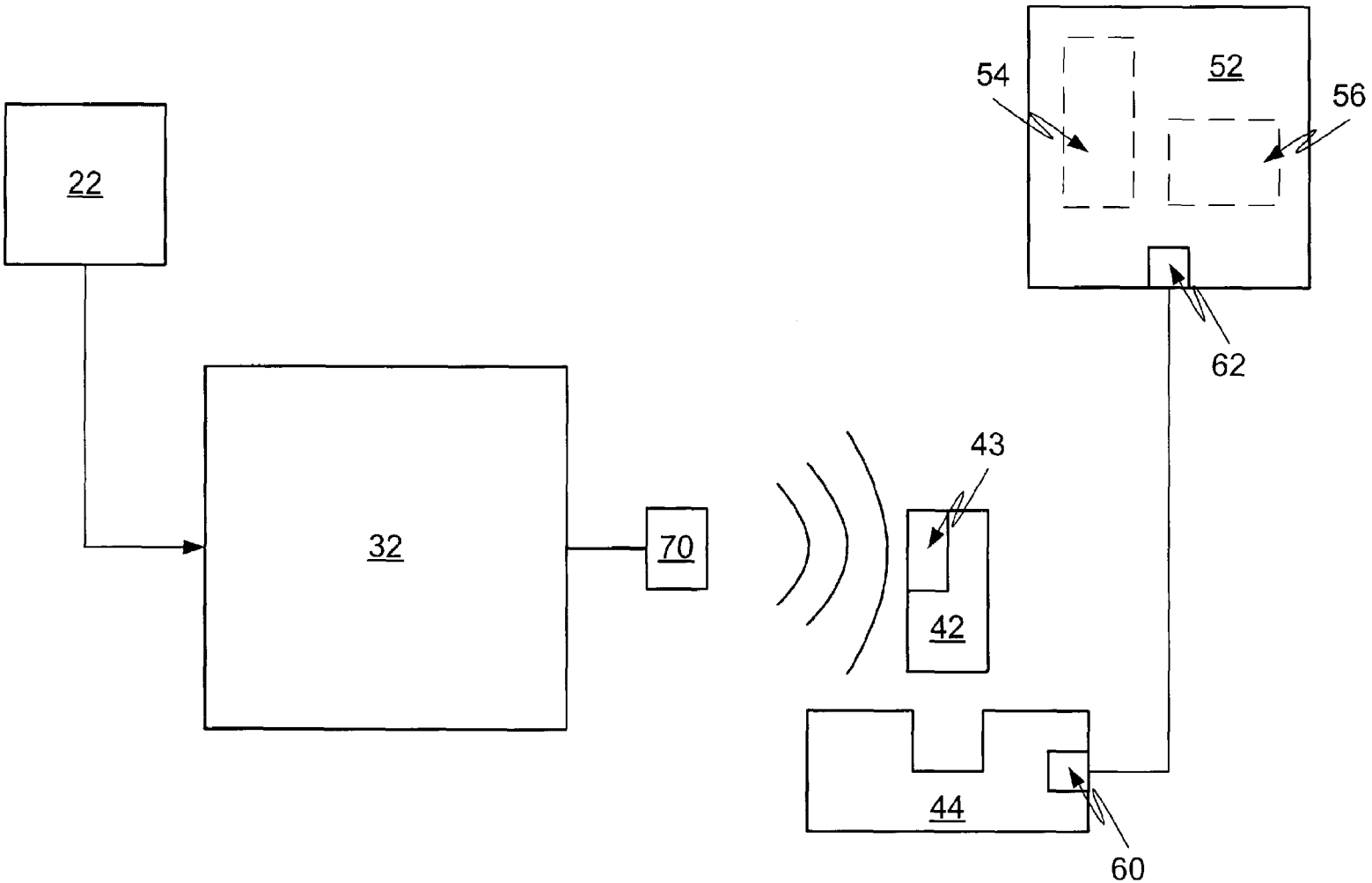
FIG. 4 is a functional block diagram for use in illustrating still further embodiments of the present invention.

As shown in FIG. 4, which illustrates certain advantageous embodiments of the system 16, the audio source 22 may be any external source capable of communicating audio data, including, but not limited to, a radio station, a television station, or a network, including, but not limited to, the Internet, a WAN (Wide Area Network), a LAN (Local Area Network), a PSTN (public switched telephone network), a cable television system, or a satellite communications system.

The audio reproducing system 32 may be any device capable of reproducing audio data from any of the audio sources referenced above at an audience member's location, including, but not limited to, a radio, a television, a stereo system, a home theater system, an audio system in a commercial establishment or public area, a personal computer, a web appliance, a gaming console, a cell phone, a pager, a PDA (Personal Digital Assistant), an MP3 player, any other device for playing digital audio files, or any other device for reproducing prerecorded media.

The system 32 causes the audio data received to be reproduced as acoustic energy. The system 32 typically includes a speaker 70 for reproducing the audio data as acoustic audio data. While the speaker 70 may form an integral part of the system 32, it may also, as shown in FIG. 4, be a peripheral of the system 32, including, but not limited to, stand-alone speakers or headphones.

In certain embodiments, the acoustic audio data is received by a transducer, illustrated by input device 43 of monitoring device 42, for producing electrical audio data from the received acoustic audio data. While the input device 43 typically is a microphone that receives the acoustic energy, the input device 43 can be any device capable of detecting energy associated with the speaker 70, such as, for example, a magnetic pickup for sensing magnetic fields, a capacitive pickup for sensing electric fields, or an antenna or optical sensor for electromagnetic energy. In other embodiments, however, the input device 43 comprises an electrical or optical connection with the system 32 for detecting the audio data.

In certain advantageous embodiments, the monitoring device 42 comprising one or more processors, is a portable monitoring device, such as, for example, a portable meter to be carried on the person of an audience member. In these embodiments, the portable device 42 is carried by an audience member in order to detect audio data to which the audience member is exposed. In some of these embodiments, the portable device 42 is later coupled with a docking station 44, which includes or is coupled to a communications device 60, in order to communicate data to, or receive data from, at least one remotely located communications device 62.

The communications device 60 is, or includes, any device capable of performing any necessary transformations of the data to be communicated, and/or communicating/receiving the data to be communicated, to or from at least one remotely located communications device 62 via a communication system, link, or medium. Such a communications device may be, for example, a modem or network card that transforms the data into a format appropriate for communication via a telephone network, a cable television system, the Internet, a WAN, a LAN, or a wireless communications system. In embodiments that communicate the data wirelessly, the communications device 60 includes an appropriate transmitter, such as, for example, a cellular telephone transmitter, a wireless Internet transmission unit, an optical transmitter, an acoustic transmitter, or a satellite communications transmitter.

In certain advantageous embodiments, the reporting system 52 comprises one or more processors and has a database 54 containing reference audio signature data of identified audio data. After audio signature data is formed in the monitoring device 42, it is compared with the reference audio signature data contained in the database 54 in order to identify the received audio data.

There are numerous advantageous and suitable techniques for carrying out a pattern matching process to identify the audio data based on the audio signature data. Some of these techniques are disclosed in U.S. Pat. No. 5,612,729 to Ellis, et al. and in U.S. Pat. No. 4,739,398 to Thomas, et al., each of which is assigned to the assignee of the present invention and both of which are incorporated herein by reference.

Still other suitable techniques are the subject of U.S. Pat. No. 2,662,168 to Scherbatskoy, U.S. Pat. No. 3,919,479 to Moon, et al., U.S. Pat. No. 4,697,209 to Kiewit, et al., U.S. Pat. No. 4,677,466 to Lert, et al., U.S. Pat. No. 5,512,933 to Wheatley, et al, U.S. Pat. No. 4,955,070 to Welsh, et al., U.S. Pat. No. 4,918,730 to Schulze, U.S. Pat. No. 4,843,562 to Kenyon, et al., U.S. Pat. No. 4,450,531 to Kenyon, et al., U.S. Pat. No. 4,230,990 to Lert, et al. U.S. Pat. No. 5,594,934 to Lu et al., and PCT Publication WO91/11062 to Young et al., all of which are incorporated herein by reference.

In certain embodiments, the signature is communicated to a reporting system 52 having a reference signature database 54, and pattern matching is carried out by the reporting system 52 to identify the audio data. In other embodiments, the reference signatures are retrieved from the reference signature database 54 by the monitoring device 42 or the docking station 44, and pattern matching is carried out in the monitoring device 42 or the docking station 44. In the latter embodiments, the reference signatures in the database can be communicated to the monitoring device 42 or the docking station 44 at any time, such as, for example, continuously, periodically, when a monitoring device 42 is coupled to a docking station 44 thereof, when an audience member actively requests such a communication, or prior to initial use of the monitoring device 42 by an audience member.

After the audio signature data is formed and/or after pattern matching has been carried out, the audio signature data, or, if pattern matching has occurred, the identity of the audio data, is stored on a storage device 56 located in the reporting system.

In certain embodiments, the reporting system 52 is a single device containing both a reference signature database 54, a pattern matching subsystem (not shown for purposes of simplicity and clarity) and the storage device. In other embodiments, 56 the reporting system 52 contains only a storage device 56 for storing the audio signature data. Such embodiments have certain advantages that may be desired, such as, for example, limiting the amount of storage space required in the device that performs the pattern matching, which can be achieved, for example, by only retrieving particular groups or subgroups of reference signatures as explained above.

Figure 5:
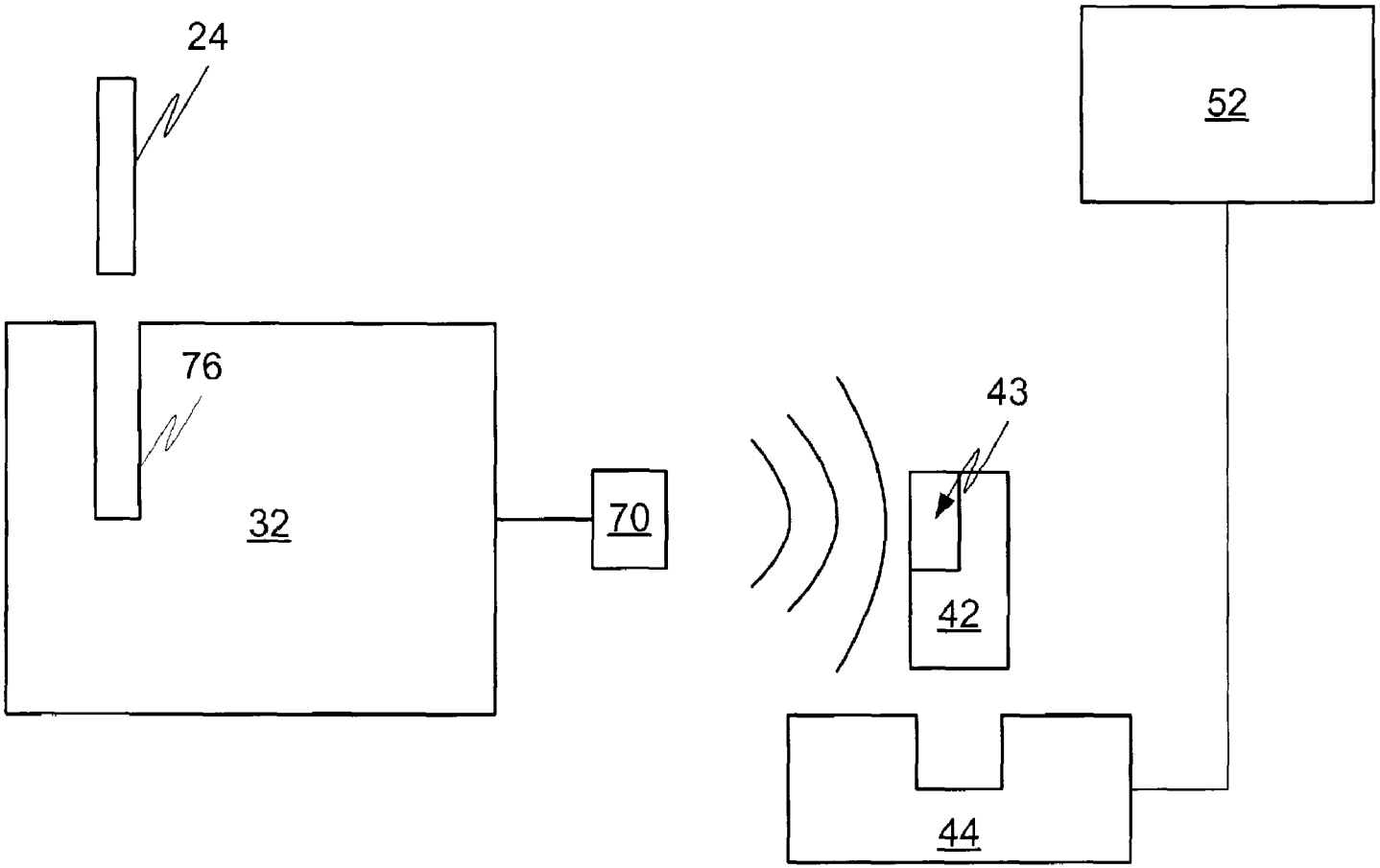
FIG. 5 is a functional block diagram for use in illustrating yet still further embodiments of the present invention.

Referring to FIG. 5, in certain embodiments, the audio source 24 is a data storage medium containing audio data previously recorded, including, but not limited to, a diskette, game cartridge, compact disc, digital versatile disk, or magnetic tape cassette, including, but not limited to, audiotapes, videotapes, or DATs (Digital Audio Tapes). Audio data from the source 24 is read by a disk drive 76 or other appropriate device and reproduced as sound by the system 32 by means of speaker 70.

Figure 6:
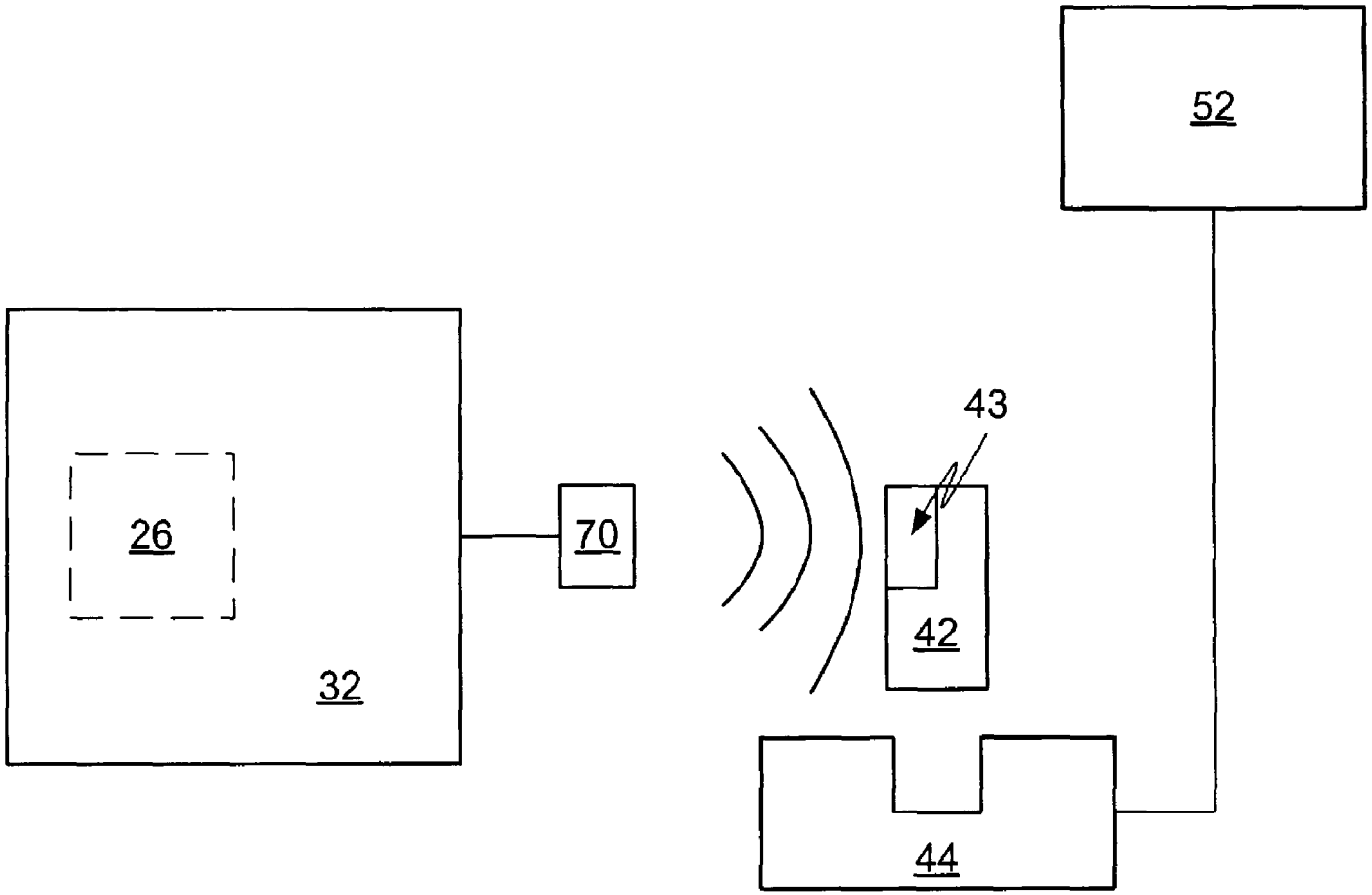
FIG. 6 is a functional block diagram for use in illustrating further embodiments of the present invention.

In yet other embodiments, as illustrated in FIG. 6, the audio source 26 is located in the system 32, either as hardware forming an integral part or peripheral of the system 32, or as software, such as, for example, in the case where the system 32 is a personal computer, a prerecorded advertisement included as part of a software program that comes bundled with the computer.

Figure 7:
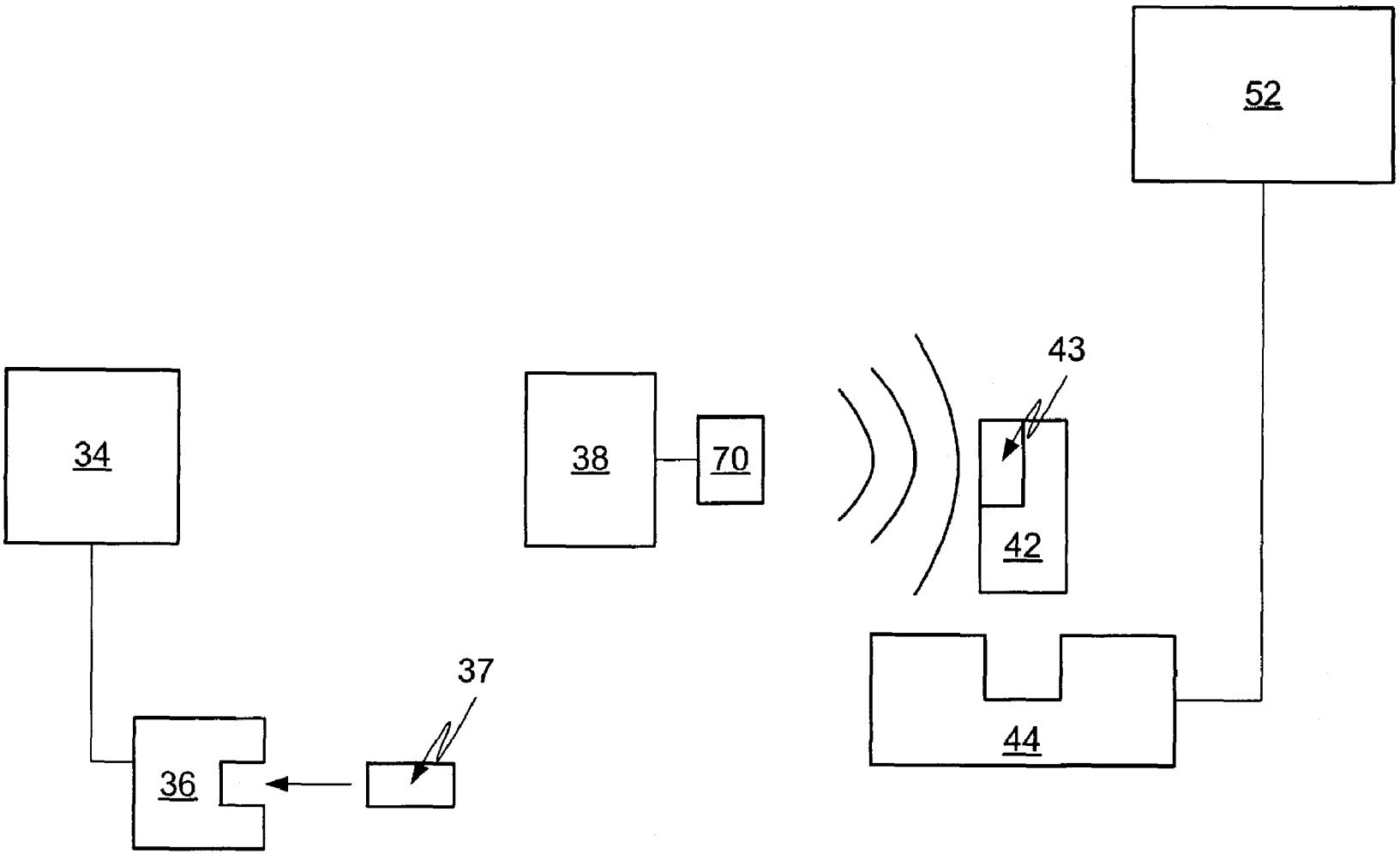
FIG. 7 is a functional block diagram for use in illustrating still further embodiments of the present invention.
Figure 8:
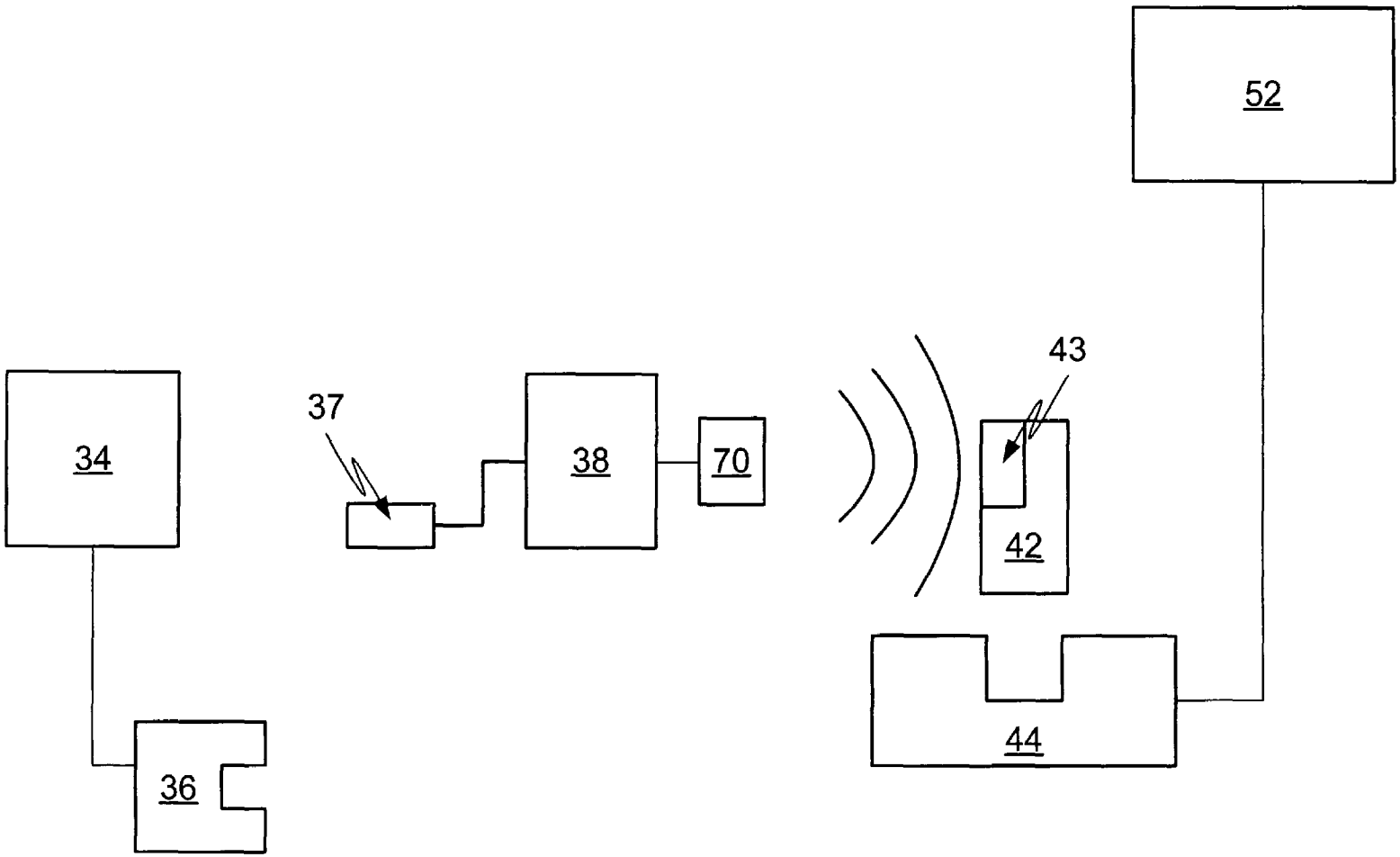
FIG. 8 is a functional block diagram for use in illustrating additional embodiments of the present invention.

In still further embodiments, the source is another audio reproducing system, as defined below, such that a plurality of audio reproducing systems receive and communicate audio data in succession. Each system in such a series of systems may be coupled either directly or indirectly to the system located before or after it, and such coupling may occur permanently, temporarily, or intermittently, as illustrated stepwise in FIGS. 7-8. Such an arrangement of indirect, intermittent couplings of systems may, for example, take the form of a personal computer 34, electrically coupled to an MP3 player docking station 36. As shown in FIG. 5, an MP3 player 37 may be inserted into the docking station 36 in order to transfer audio data from the personal computer 34 to the MP3 player 37. At a later time, as shown in FIG. 6, the MP3 player 37 may be removed from the docking station 36 and be electrically connected to a stereo 38.

Figure 9:
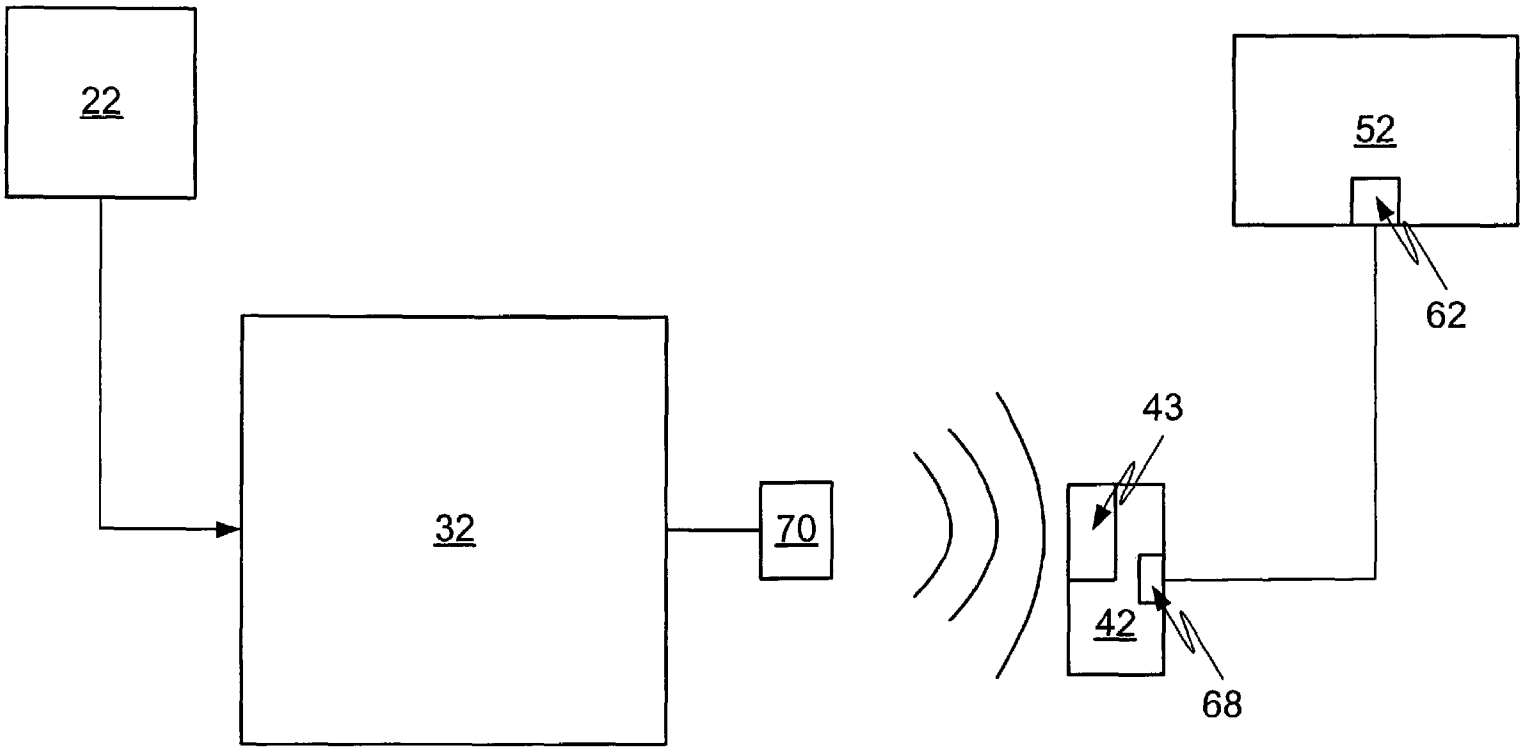
FIG. 9 is a functional block diagram for use in illustrating further additional embodiments of the present invention.

Referring to FIG. 9, in certain embodiments, the portable device 42 itself includes or is coupled to a communications device 68, in order to communicate data to, or receive data from, at least one remotely located communications device 62.

Figure 10:
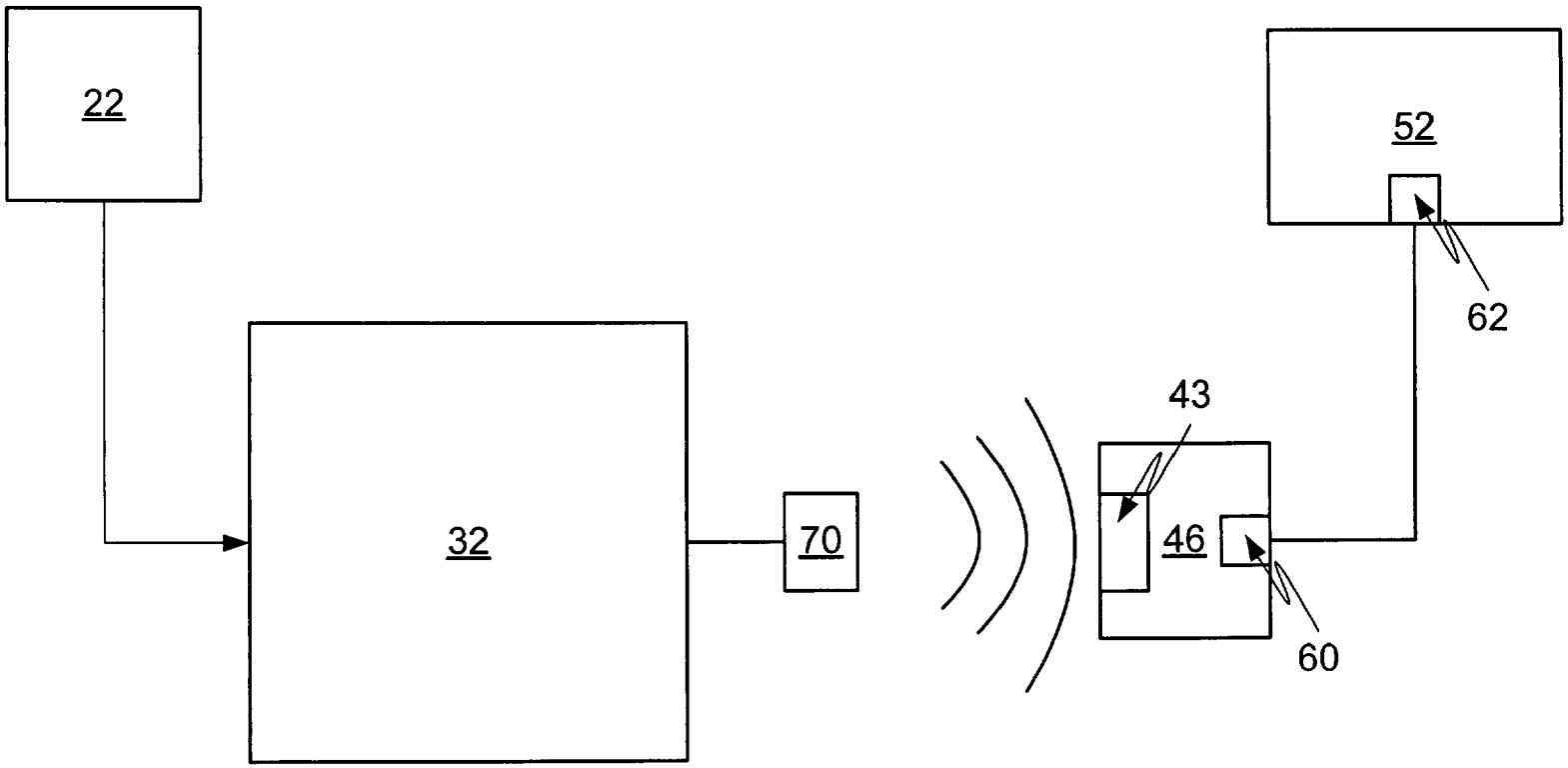
FIG. 10 is a functional block diagram for use in illustrating still further additional embodiments of the present invention.

In certain other embodiments, as illustrated in FIG. 10, the monitoring device 46, comprising one or more processors, is a stationary monitoring device that is positioned near the system 32. In these embodiments, while a separate communications device for communicating data to, or receiving data from, at least one remotely located communications device 62 may be coupled to the monitoring device 46, the communications device 60 will typically be contained within the monitoring device 46.

Figure 11:
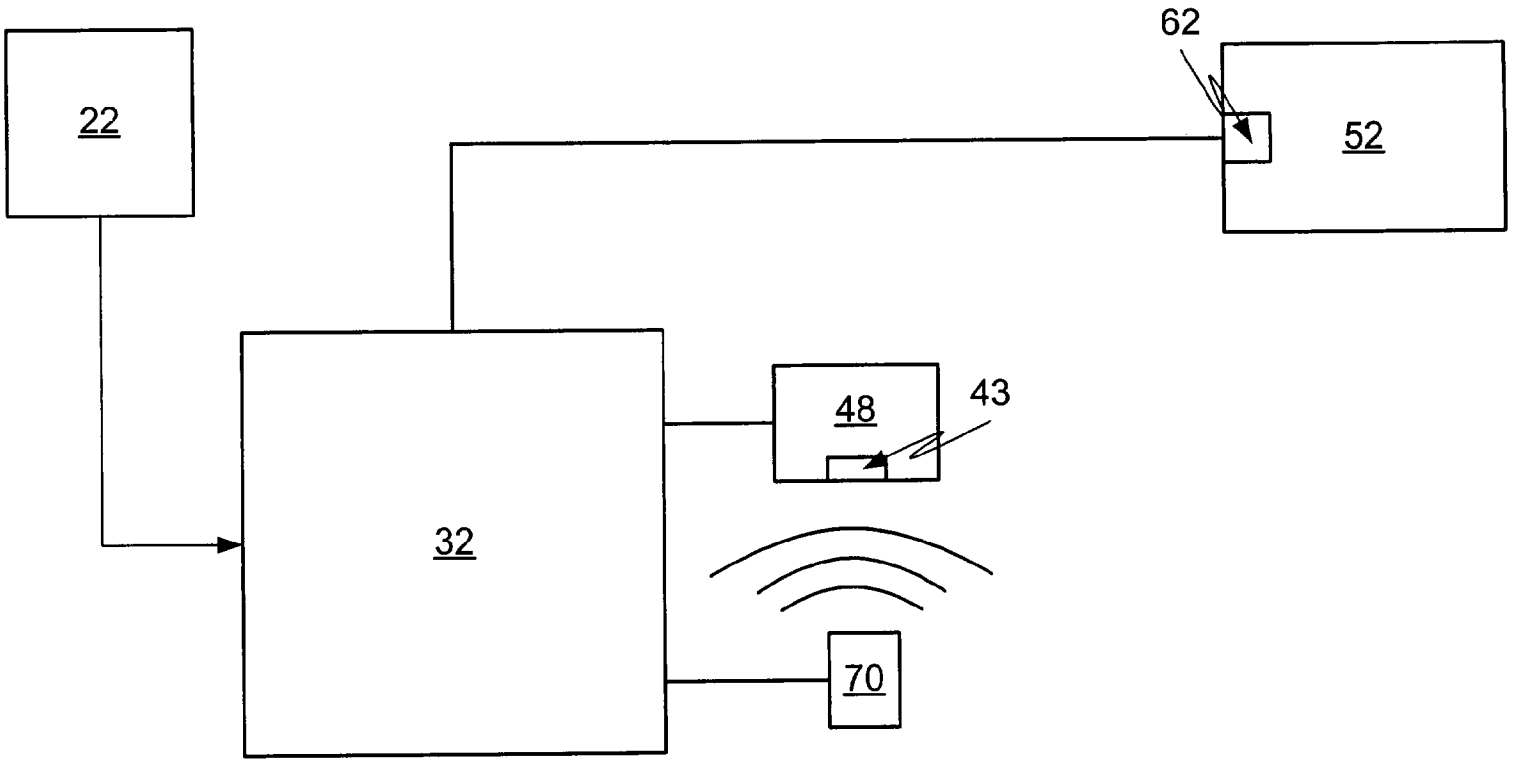
FIG. 11 is a functional block diagram for use in illustrating yet further additional embodiments of the present invention.

In still other embodiments, as illustrated in FIG. 11, the monitoring device 48, comprising one or more processors, is a peripheral of the system 32. In these embodiments, the data to be communicated to or from at least one remotely located communications device 62 is communicated from the monitoring device 48 to the system 32, which in turn communicates the data to, or receives the data from, the remotely located communications device 62 via a communication system, link or medium.

Figure 12:
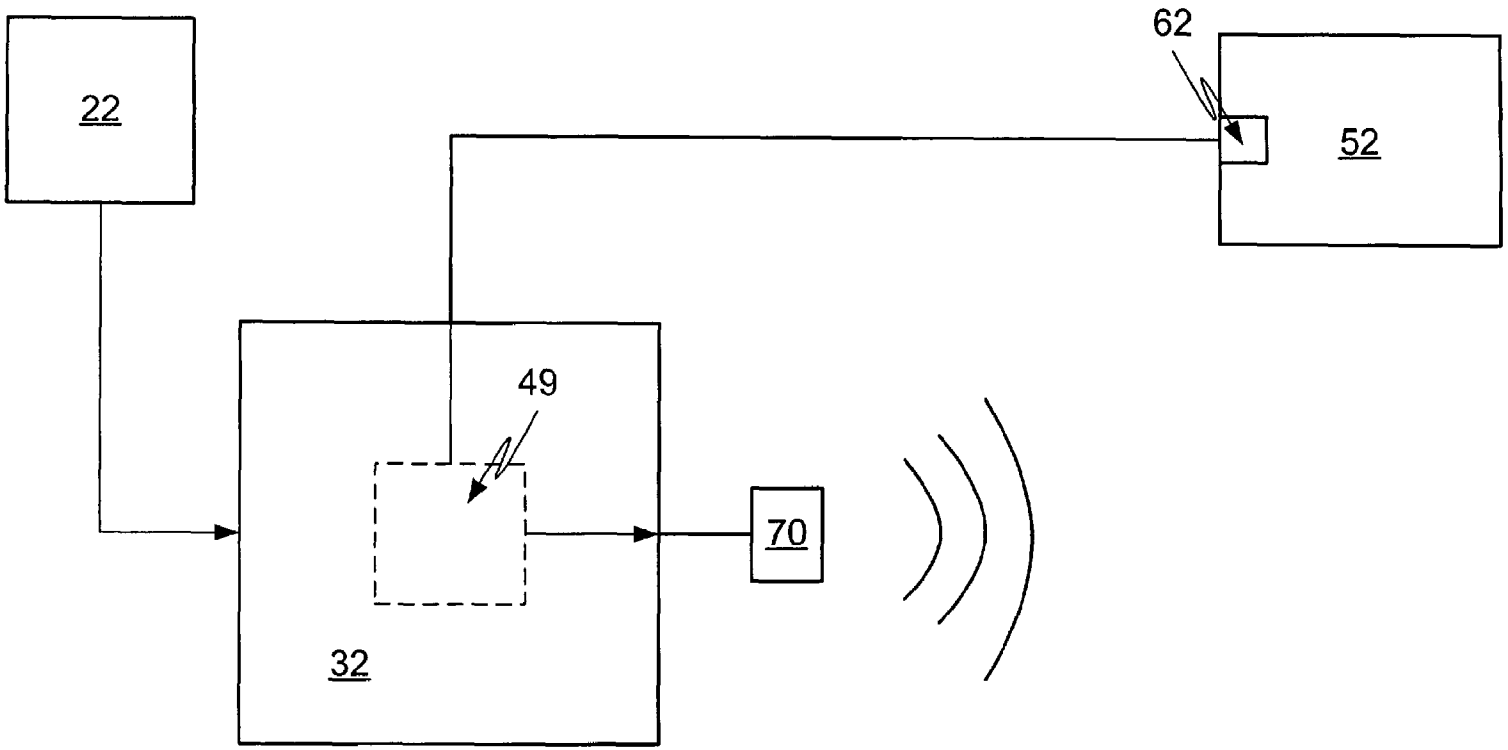
FIG. 12 is a functional block diagram for use in illustrating additional embodiments of the present invention.

In still further embodiments, as illustrated in FIG. 12, the monitoring device 49 is embodied in monitoring software operating in the system 32. In these embodiments, the system 32 communicates the data to be communicated to, or receives the data from, the remotely located communications device 62.

Figure 13:
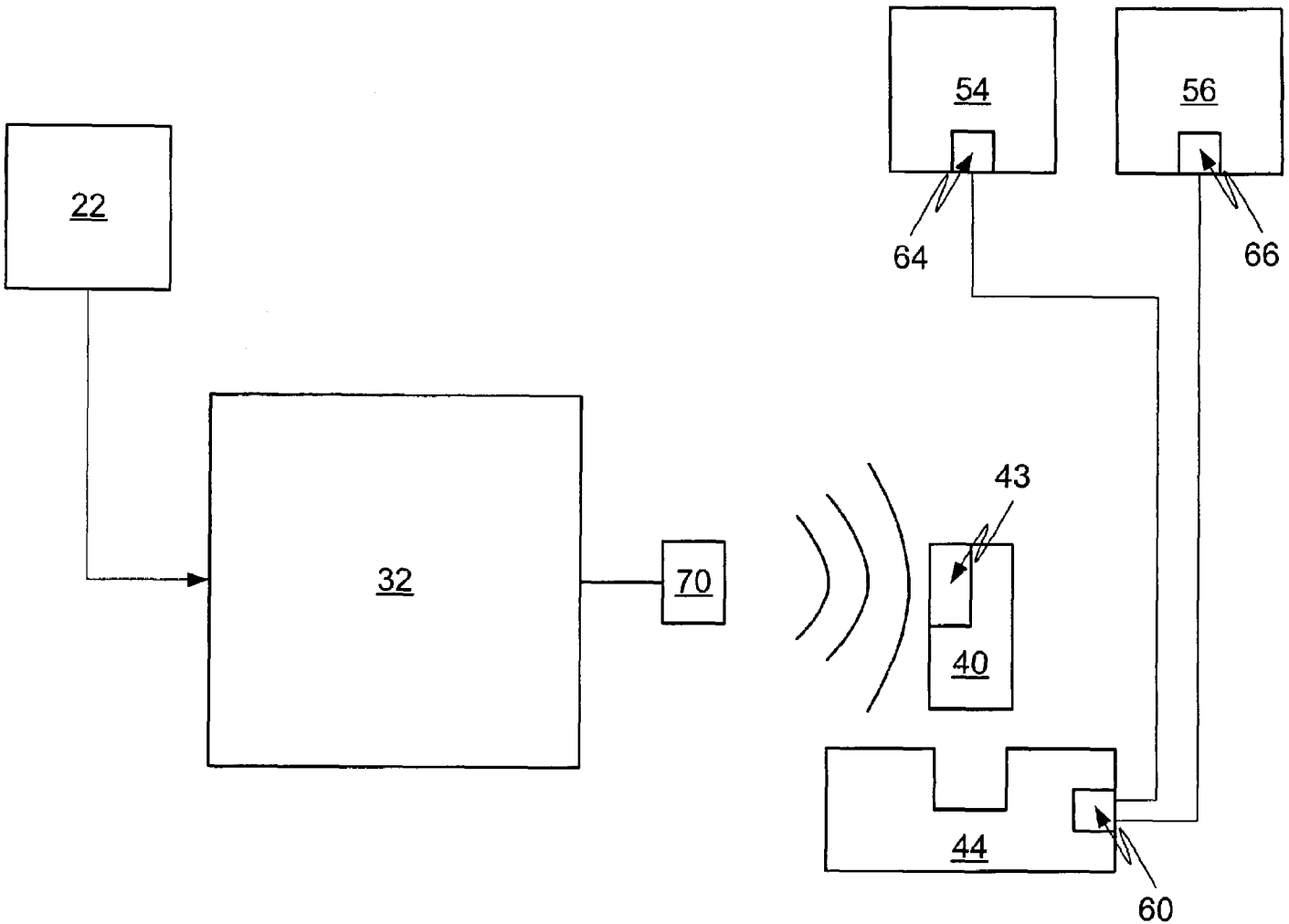
FIG. 13 is a functional block diagram for use in illustrating further additional embodiments of the present invention.
Figure 14:
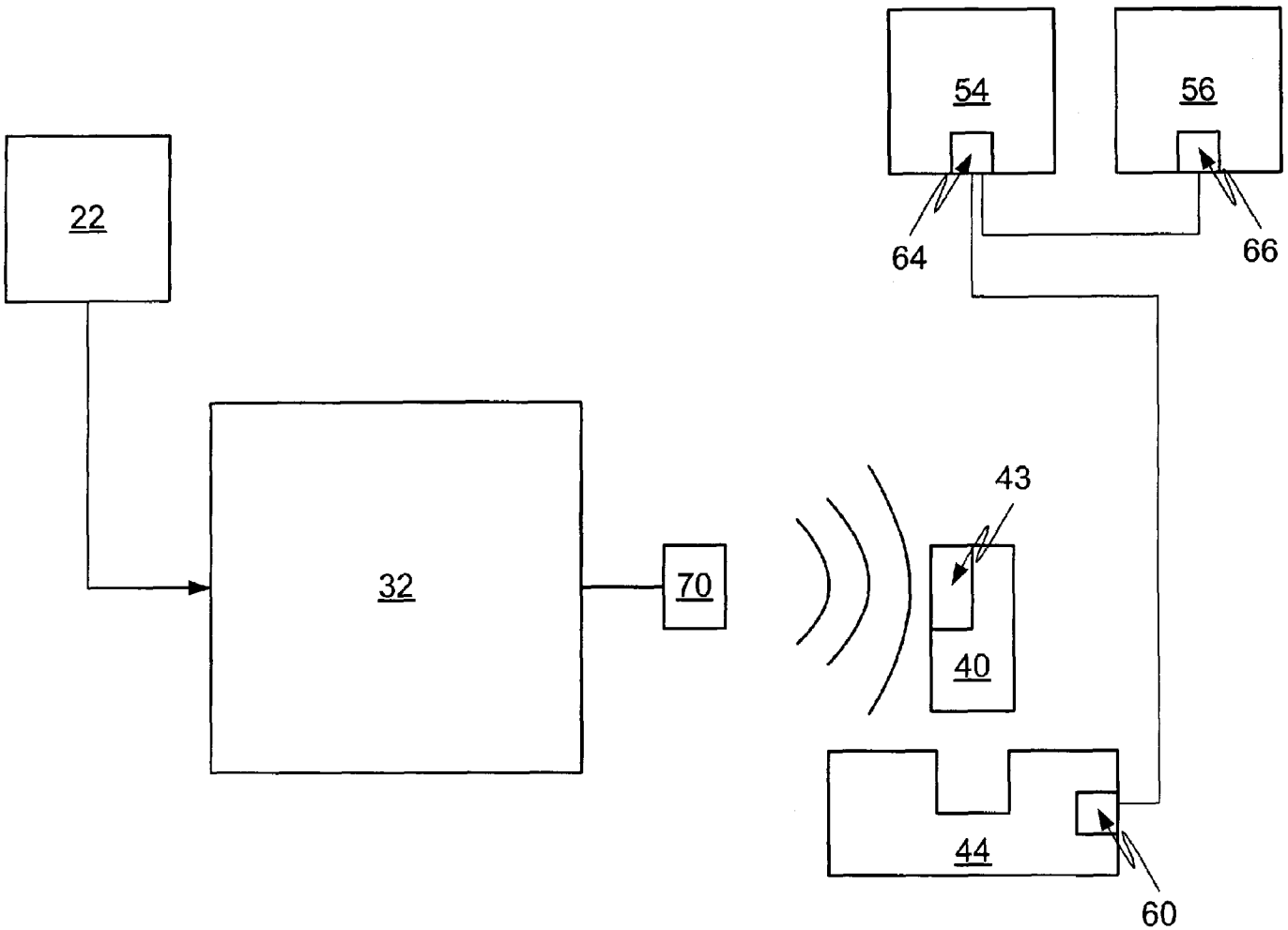
FIG. 14 is a functional block diagram for use in illustrating still further additional embodiments of the present invention.

Referring to FIG. 13, in certain embodiments, a reporting system comprises a database 54 and storage device 56 that are separate devices, which may be coupled to, proximate to, or located remotely from, each other, and which include communications devices 64 and 66, respectively, for communicating data to or receiving data from communications device 60. In embodiments where pattern matching occurs, data resulting from such matching may be communicated to the storage device 56 either by the monitoring device 40 or a docking station 44 thereof, as shown in FIG. 13, or by the reference signature database 54 directly therefrom, as shown in FIG. 14.

Although the invention has been described with reference to particular arrangements and embodiments of services, systems, processors, devices, features and the like, these are not intended to exhaust all possible arrangements or embodiments, and indeed many other modifications and variations will be ascertainable to those of skill in the art.

What is claimed is:

1. A method of identifying audio data received at an audience member's location, comprising:

obtaining signature data from the received audio data, wherein said signature data characterizes the received audio data;

obtaining additional data from the received audio data, wherein the additional data comprises at least one ancillary code encoded within the received audio data, and wherein at least a portion of the additional data is independent of the signature data; and producing an identification of the received audio data based both on the signature data and the additional data.

2. The method of claim 1, wherein obtaining the signature data comprises forming a signature data set reflecting time-domain variations of the received audio data.

3. The method of claim 2, wherein obtaining the signature data further comprises forming a signature data set reflecting time-domain variations of the received audio data in a plurality of frequency sub-bands of the received audio data.

4. The method of claim 1, wherein obtaining the signature data comprises forming a signature data set reflecting frequency-domain variations in the received audio data.

5. The method of claim 1, wherein the additional data comprises a plurality of substantially single-frequency code components.

6. The method of claim 5, further comprising processing the received audio data to produce signal-to-noise ratios for the plurality of components.

7. The method of claim 1, wherein obtaining the signature data comprises forming a signature data set comprising signal-to-noise ratios for frequency components of the audio data and/or data representing characteristics of the audio data.

8. The method of claim 7, wherein obtaining the signature data further comprises combining selected ones of the signal-to-noise ratios.

9. The method of claim 7, wherein obtaining the signature data further comprises forming a signature data set reflecting time-domain variations of the signal-to-noise ratios.

10. The method of claim 9, wherein obtaining the signature data further comprises forming a signature data set reflecting time-domain variations of the signal-to-noise ratios in a plurality of frequency sub-bands of the received audio data.

11. The method of claim 10, wherein the sub-bands are substantially single-frequency sub-bands.

12. The method of claim 7, wherein obtaining the signature data further comprises forming a signature data set reflecting frequency-domain variations of the signal-to-noise ratios.

13. The method of claim 12, wherein the signal-to-noise ratios reflect the ratios of the magnitudes of substantially single-frequency components data to noise levels.

14. The method of claim 1, wherein the signature data comprises data obtained from the additional data and/or a source identification code included in the audio data.

15. The method of claim 14, wherein the additional data and the source identification code occur simultaneously in the audio data.

16. The method of claim 14, wherein the additional data and the source identification code occur in different time segments of the audio data.

17. The method of claim 1, wherein the step of identifying the received audio data comprises comparing the obtained signature data to reference signature data of identified audio data.

18. The method of claim 1, wherein identifying the received audio data comprises:

selecting a signature subset of reference audio data signatures from a library of reference audio data signatures, each which signatures characterizes identified audio data, based on the additional data; and comparing the signature data to at least one reference audio data signature in the signature subset to identify the received audio data.

19. The method of claim 18, wherein obtaining the signature data comprises forming a signature data set reflecting time-domain variations of the received audio data.

20. The method of claim 19, wherein obtaining the signature data further comprises forming a signature data set reflecting time-domain variations of the received audio data in a plurality of frequency sub-bands of the received audio data.

21. The method of claim 18, wherein obtaining the signature data comprises forming a signature data set reflecting frequency-domain variations in the received audio data.

22. The method of claim 18, wherein the additional data comprises a plurality of substantially single-frequency code components.

23. The method of claim 22, further comprising processing the received audio data to produce signal-to-noise ratios for the plurality of components.

24. The method of claim 18, wherein obtaining the signature data comprises forming a signature data set comprising signal-to-noise ratios for frequency components of the audio data and/or data representing characteristics of the audio data.

25. The method of claim 24, wherein obtaining the signature data further comprises combining selected ones of the signal-to-noise ratios.

26. The method of claim 24, wherein obtaining the signature data further comprises forming a signature data set reflecting time-domain variations of the signal-to-noise ratios.

27. The method of claim 26, wherein obtaining the signature data further comprises forming a signature data set reflecting time-domain variations of the signal-to-noise ratios in a plurality of frequency sub-bands of the received audio data.

28. The method of claim 27, wherein the sub-bands are substantially single-frequency sub-bands.

29. The method of claim 24, wherein obtaining the signature data further comprises forming a signature data set reflecting frequency-domain variations of the signal-to-noise ratios.

30. The method of claim 29, wherein the signal-to-noise ratios reflect the ratios of the magnitudes of substantially single-frequency components data to noise levels.

31. The method of claim 18, wherein the signature data comprises data obtained from the additional data and/or a source identification code included in the audio data.

32. The method of claim 31, wherein the additional data and the source identification code occur simultaneously in the audio data.

33. The method of claim 31, wherein the additional data and the source identification code occur in different time segments of the audio data.

34. The method of claim 1, wherein identification of the received audio data comprises encoding the ancillary data to allow selection of a signature subset of reference audio data signatures from a library of reference audio data signatures characterizing identified audio data, said ancillary data occurring at least one of (a) simultaneously in the audio data, and (b) in different time segments of the audio data.

35. A system for identifying audio data received at an audience member's location, comprising:

a first means to obtain signature data from the received audio data, wherein said signature data characterizes the received audio data;

a second means to obtain additional data from the received audio data, wherein the additional data comprises at least one ancillary code encoded within the received audio data, and wherein at least a portion of the additional data is independent of the signature data; and a third means to produce an identification of the received audio data based both on the signature data and the additional data.

36. The system of claim 35, wherein the first means is operative to obtain the signature data by forming a signature data set reflecting time-domain variations of the received audio data.

37. The system of claim 36, wherein the first means is further operative to obtain the signature data by forming a signature data set reflecting time-domain variations of the received audio data in a plurality of frequency sub-bands of the received audio data.

38. The system of claim 35, wherein the first means is operative to obtain the signature data by forming a signature data set reflecting frequency-domain variations in the received audio data.

39. The system of claim 35, wherein the additional data comprises a plurality of substantially single-frequency code components.

40. The system of claim 39, wherein the first means is operative to process the received audio data to produce signal-to-noise ratios for the plurality of components.

41. The system of claim 35, wherein the first means is operative to obtain the signature data by forming a signature data set comprising signal-to-noise ratios for frequency components of the audio data and/or data representing characteristics of the audio data.

42. The system of claim 41, wherein the first means is further operative to obtain the signature data by combining selected ones of the signal-to-noise ratios.

43. The system of claim 41, wherein the first means is further operative to obtain the signature data by forming a signature data set reflecting time-domain variations of the signal-to-noise ratios.

44. The system of claim 43, wherein the first means is further operative to obtain the signature data by forming a signature data set reflecting time-domain variations of the signal-to-noise ratios in a plurality of frequency sub-bands of the received audio data.

45. The system of claim 44, wherein the sub-bands are substantially single-frequency sub-bands.

46. The system of claim 41, wherein the first means is further operative to obtain the signature data by forming a signature data set reflecting frequency-domain variations of the signal-to-noise ratios.

47. The system of claim 46, wherein the signal-to-noise ratios reflect the ratios of the magnitudes of substantially single-frequency components data to noise levels.

48. The system of claim 35, wherein the signature data comprises data obtained from the additional data and/or a source identification code included in the audio data.

49. The system of claim 48, wherein the additional data and the source identification code occur simultaneously in the audio data.

50. The system of claim 48, wherein the additional data and the source identification code occur in different time segments of the audio data.

51. The system of claim 35, wherein the third means is operative to compare the obtained signature data to reference signature data of identified audio data.

52. The system of claim 35, wherein the third means comprises:

a first means to select a signature subset of reference audio data signatures from a library of reference audio data signatures, each of which signatures characterizes identified audio data, based on the additional data; and a second means to compare the signature data to at least one reference audio data signature in the signature subset to identifier the received audio data.

53. The system of claim 52, wherein the first means is operative to obtain the signature data by forming a signature data set reflecting time-domain variations of the received audio data.

54. The system of claim 53, wherein the first means is further operative to obtain the signature data by forming a signature data set reflecting time-domain variations of the received audio data in a plurality of frequency sub-bands of the received audio data.

55. The system of claim 52, wherein the first means is operative to obtain the signature data by forming a signature data set reflecting frequency-domain variations in the received audio data.

56. The system of claim 52, wherein the additional data comprises a plurality of substantially single-frequency code components.

57. The system of claim 56, wherein the first means is operative to process the received audio data to produce signal-to-noise ratios for the plurality of components.

58. The system of claim 52, wherein the first means is operative to obtain the signature data by forming a signature data set comprising signal-to-noise ratios for frequency components of the audio data anchor data representing characteristics of the audio data.

59. The system of claim 58, wherein the first means is further operative to obtain the signature data by combining selected ones of the signal-to-noise ratios.

60. The system of claim 58, wherein the first means is further operative to obtain the signature data by forming a signature data set reflecting time-domain variations of the signal-to-noise ratios.

61. The system of claim 60, wherein the first means is further operative to obtain the signature data by forming a signature data set reflecting time-domain variations of the signal-to-noise ratios in a plurality of frequency sub-bands of the received audio data.

62. The system of claim 61, wherein the sub-bands are substantially single-frequency sub-bands.

63. The system of claim 58, wherein the first means is further operative to obtain the signature data by forming a signature data set reflecting frequency-domain variations of the signal-to-noise ratios.

64. The system of claim 63, wherein the signal-to-noise ratios reflect the ratios of the magnitudes of substantially single-frequency components data to noise levels.

65. The system of claim 52, wherein the signature data comprises data obtained from the additional data and/or a source identification code included in the audio data.

66. The system of claim 65, wherein the additional data and the source identification code occur simultaneously in the audio data.

67. The system of claim 65, wherein the additional data and the source identification code occur in different time segments of the audio data.

68. The system of claim 35, wherein the third means comprises means for encoding the ancillary code to allow selection of a signature subset of reference audio data signatures from a library of reference audio data signatures characterizing identified audio data, said ancillary data occurring at least one of (a) simultaneously in the audio data, and (b) in different time segments of the audio data.

69. A method of encoding audio data for gathering data reflecting receipt of and/or exposure to the audio data, comprising:

forming a database having a plurality of reference signature data sets, wherein each of the signature data sets characterizes the audio data for identification;

grouping the reference signature data sets into a plurality of respective signature data groups; and encoding audio data with additional data comprising an ancillary code that denotes at least one of the signature data groups, wherein the encoded audio data is identifiable based on the ancillary code and the at least one denoted signature data group.

70. The method of claim 69, wherein forming the database comprises forming the plurality of signature data sets, wherein each of the sets reflects time-domain variations of identified audio data.

71. The method of claim 70, wherein forming the database further comprises forming the plurality of signature data sets, wherein each of the sets reflects time-domain variations of identified audio data in a plurality of frequency sub-bands of the identified audio data.

72. The method of claim 69, wherein forming the database comprises forming the plurality of signature data sets, wherein each of the sets reflects frequency-domain variations in the identified audio data.

73. The method of claim 69, wherein the data denoting one of the signature data groups comprises a plurality of substantially single-frequency code components.

74. The method of claim 69, wherein forming the database comprises forming the plurality of signature data sets, wherein each of the sets comprises signal-to-noise ratios for frequency components of the audio data and/or data representing characteristics of the audio data.

75. The method of claim 74, wherein forming the signature data sets further comprises combining selected ones of the signal-to-noise ratios.

76. The method of claim 74, wherein forming the database further comprises forming the plurality of signature data sets, wherein each of the sets reflects time-domain variations of the signal-to-noise ratios.

77. The method of claim 76, wherein forming the database further comprises forming a plurality of signature data sets, wherein each of the sets reflects time-domain variations of the signal-to-noise ratios in a plurality of frequency sub-bands of the identified audio data.

78. The method of claim 77, wherein the sub-bands are substantially single-frequency sub-bands.

79. The method of claim 74, wherein forming the database further comprises forming a plurality of signature data sets, wherein each of the sets reflects frequency-domain variations of the signal-to-noise ratios.

80. The method of claim 79, wherein the signal-to-noise ratios reflect the ratios of the magnitudes of substantially single-frequency components data to noise levels.

81. The method of claim 69, wherein the signature data comprises data obtained from the data denoting one of the signature data groups and/or a source identification code included in the audio data.

82. The method of claim 81, wherein the data denoting one of the signature data groups and the source identification code occur simultaneously in the audio data.

83. The method of claim 81, wherein the data denoting one of the signature data groups and the source identification code occur in different time segments of the audio data.

84. The method of claim 69, further comprising further grouping the reference signature data sets into a plurality of signature data subgroups.

85. The method of claim 69, wherein encoding audio data comprises encoding the ancillary code to allow selection of a signature subset of reference audio data signatures from a library of reference audio data signatures characterizing identified audio data, said ancillary data occurring at least one of (a) simultaneously in the audio data, and (b) in different time segments of the audio data.

86. A system for encoding audio data for gathering data reflecting receipt of and/or exposure to the audio data, comprising:

a database having a plurality of signature data groups, wherein each of the signature data groups has at least one reference signature data set that characterizes audio data for identification; and an encoder to encode audio data to be monitored with additional data comprising ancillary code that denotes at least one of the signature data groups, wherein the encoded audio data is identifiable based on the ancillary code and the denoted signature data group.

87. The system of claim 86, wherein each reference signature data set reflects time-domain variations of identified audio data.

88. The system of claim 87, wherein each reference signature data set reflects time-domain variations of identified audio data in a plurality of frequency sub-bands of the identified audio data.

89. The system of claim 86, wherein each reference signature data set reflects frequency-domain variations in the identified audio data.

90. The system of claim 86, wherein the data denoting one of the signature data groups comprises a plurality of substantially single-frequency code components.

91. The system of claim 86, wherein each reference signature data set comprises signal-to-noise ratios for frequency components of the audio data and/or data representing characteristics of the audio data.

92. The system of claim 91, wherein each reference signature data set comprises a combination of selected ones of the signal-to-noise ratios.

93. The system of claim 91, wherein each reference signature data set reflects frequency-domain variations of the signal-to-noise ratios.

94. The system of claim 93, wherein the signal-to-noise ratios reflect the ratios of the magnitudes of substantially single-frequency components data to noise levels.

95. The system of claim 90, wherein each reference signature data set reflects time-domain variations of the signal-to-noise ratios.

96. The system of claim 95, wherein each reference signature data set reflects time-domain variations of the signal-to-noise ratios in a plurality of frequency sub-bands of the identified audio data.

97. The system of claim 96, wherein the sub-bands are substantially single-frequency sub-bands.

98. The system of claim 86, wherein the signature data comprises data obtained from the data denoting one of the signature groups and/or a source identification code included in the audio data.

99. The system of claim 98, wherein the data denoting one of the signature data groups and the source identification code occur simultaneously in the audio data.

100. The system of claim 98, wherein the data denoting one of the signature data groups and the source identification code occur in different time segments of the audio data.

101. The system of claim 86, wherein the reference signatures are further grouped into reference signature data subgroups.

102. A system for identifying audio data received at an audience member's location, comprising:

a monitoring device comprising an input that receives audio data and is configured to obtain (1) signature data from the received audio data, wherein said signature data characterizes the received audio data, and (2) additional data from the received audio data, wherein the additional data comprises an ancillary code encoded within the received audio data, and wherein at least a portion of the additional data is independent of the signature data; and a reporting system, coupled to the monitoring device, wherein the reporting system is configured to process both the signature data and the additional data to produce an identification of a program segment.

103. The system as recited in claim 102, wherein the monitoring device comprises a processor for obtaining the signature data and the additional data.

104. The system as recited in claim 102, wherein the reporting system comprises one or more processors to select a signature subset of reference audio data signatures, each of which signatures characterizes identified audio data, based on the additional data, and a database for comparison of the signature data to at least one reference audio data signature in the signature subset to identify the received audio data.

* * * * *